US007258900B2

(12) United States Patent
Raksha et al.

(10) Patent No.: US 7,258,900 B2
(45) Date of Patent: Aug. 21, 2007

(54) MAGNETIC PLANARIZATION OF PIGMENT FLAKES

(75) Inventors: Vladimir P. Raksha, Santa Rosa, CA (US); Charles T. Markantes, Santa Rosa, CA (US); Dishuan Chu, Rohnert Park, CA (US); Paul G. Coombs, Santa Rosa, CA (US)

(73) Assignee: JDS Uniphase Corporation, Milpitas, CA (US)

( * ) Notice: Subject to any disclaimer, the term of this patent is extended or adjusted under 35 U.S.C. 154(b) by 0 days.

(21) Appl. No.: 10/293,817

(22) Filed: Nov. 13, 2002

(65) Prior Publication Data

US 2004/0009309 A1 Jan. 15, 2004

Related U.S. Application Data

(60) Provisional application No. 60/410,546, filed on Sep. 13, 2002, provisional application No. 60/410,547, filed on Sep. 13, 2002, provisional application No. 60/396,210, filed on Jul. 15, 2002.

(51) Int. Cl.
*H01F 1/00* (2006.01)

(52) U.S. Cl. ..... 427/548; 427/549; 427/550; 427/598; 427/599; 427/128; 427/130; 427/132

(58) Field of Classification Search ..... 427/548, 427/549, 550, 598, 599, 128, 130, 132, 385.5; *H01F 1/00*
See application file for complete search history.

(56) References Cited

U.S. PATENT DOCUMENTS 3,676,273 A 7/1970 Graves ..... 161/3

(Continued)

FOREIGN PATENT DOCUMENTS

EP 0556449 A1 8/1993

(Continued)

OTHER PUBLICATIONS

Dobrowolski et al., *Research on Thin Film Anticounterfeiting Coatings at the National Research Council of Canada*, Applied Optics, vol. 28, No. 14, pp. 2702-2717 (Jul. 15, 1989).

*Primary Examiner*—Bret Chen
(74) *Attorney, Agent, or Firm*—Allen, Dyer, Doppelt, Milbrath & Gilchrist, P.A.

(57) ABSTRACT

A magnetic field is applied to planarize magnetic pigment flakes relative to a surface. Pigment flakes, such as optically variable pigment flakes, are used in a variety of paints, inks, extrusions, powder coatings, and other forms for decorative and security applications. In many applications pigment flakes tend to align parallel to each other and to the surface to which they are applied. If the pigment flakes include a suitable magnetic structure, a magnetic field can be applied to subsequently align the flakes or enhance the alignment of the flakes in the plane of the substrate if the carrier that the flakes are dispersed in is still fluid. In some printing operations, pigment flakes that are applied parallel to the substrate are pulled out of plane when the print screen or printing die is lifted off the substrate. Application of a magnetic field can re-align pigment flakes to the plane of the substrate, enhancing the visual quality of the printed image, especially with optically variable pigments.

11 Claims, 4 Drawing Sheets

U.S. PATENT DOCUMENTS 3,790,407 A * 12/1970 Merten et al. ..... 117/240
3,621,103 A * 11/1971 Campbell ..... 373/47
3,791,864 A 2/1974 Steingroever ..... 117/238
3,853,676 A 12/1974 Graves ..... 161/5
3,998,160 A 12/1976 Pearce ..... 101/488
4,248,918 A * 2/1981 Hornibrook et al. ..... 428/40
4,350,719 A * 9/1982 Baldi ..... 427/253
5,079,085 A 1/1992 Hashimoto et al. ..... 428/327
5,192,611 A 3/1993 Tomiyama et al. ..... 428/354
5,364,689 A 11/1994 Kashiwagi et al. ..... 428/195
5,424,119 A 6/1995 Phillips et al. ..... 428/328
5,543,911 A * 8/1996 Jeffers ..... 356/71
5,630,877 A * 5/1997 Kashiwagi ..... 118/623
5,643,686 A * 7/1997 Isshiki et al. ..... 428/839.3
5,645,917 A * 7/1997 Ejiri et al. ..... 428/141
5,965,194 A * 10/1999 Truong et al. ..... 427/127
5,979,774 A * 11/1999 Urushibata ..... 235/493
6,033,782 A 3/2000 Hubbard et al. ..... 428/407
6,097,531 A * 8/2000 Sheridon ..... 359/296
6,103,361 A 8/2000 Batzar et al. ..... 428/323
6,171,504 B1 * 1/2001 Patterson ..... 210/695
6,589,331 B2 7/2003 Ostertag et al. ..... 106/460
6,649,256 B1 * 11/2003 Buczek et al. ..... 428/323
6,650,815 B2 * 11/2003 Hawtof et al. ..... 385/128
6,650,887 B2 * 11/2003 McGregor et al. ..... 455/406
6,808,806 B2 * 10/2004 Phillips et al. ..... 428/403
2001/0000236 A1 * 4/2001 Benoit et al. ..... 428/900
2002/0182383 A1 * 12/2002 Phillips et al. ..... 428/199
2004/0051297 A1 3/2004 Raksha et al. ..... 283/57
2004/0052976 A1 * 3/2004 Buczek et al. ..... 427/598

FOREIGN PATENT DOCUMENTS

EP 406667 B1 1/1995
EP 710508 A1 5/1996
WO WO88/07214 * 9/1988
WO WO8807214 9/1988
WO WO 02090002 11/2002

* cited by examiner

MAGNETIC PLANARIZATION OF PIGMENT FLAKES

CROSS-REFERENCE TO RELATED APPLICATIONS

This patent application claims priority from U.S. Provisional Patent Application Ser. No. 60/410,546 filed Sep. 13, 2002 by Vladimir P. Raksha, from U.S. Provisional Patent Application Ser. No. 60/410,547 filed Sep. 13, 2002 by Vladimir P. Raksha, Paul G. Coombs, Charles T. Markantes, Dishuan Chu, and Jay M. Holman, and from U.S. Provisional Patent Application Ser. No. 60/396,210 filed Jul. 15, 2002 by Vladimir P. Raksha, Paul G. Coombs, Charles T. Markantes, Dishuan Chu, and Jay M. Holman, the disclosures of which are hereby incorporated in their entirety for all purposes.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

This invention relates generally to printing or fabricating objects with pigment flakes, and more particularly to magnetically aligning pigment flakes in a plane to enhance the cumulative visual effect of the flakes.

Pigment flakes are used in a variety of applications, such as paint, inks, textiles, cosmetics, extruded films, plastic castings, and powder coatings. Different types of pigment flakes can provide various, and often striking, visual effects. Color shifting is an example of a visual effect that can be obtained using pigment flakes. The pigment flakes can have an optical interference structure, such as a Fabry-Perot structure or thin-film stack, that changes color as the flake is tilted with respect to the viewing angle. Examples of such color-shifting images are used as security features on bank notes, like the U.S. 20-dollar bill, and for decorative purposes on and in a wide variety of consumer items, including vehicles, helmets, eye glass frames, fingernail polish, and cell-phone cases, to name a few. Other examples of pigment flakes include reflective flake pigments and diffractive flake pigments.

In many applications, the pigment flakes tend to align in a plane of the object, such as the printed paper, to produce a visual optical effect from the aggregate effect of the individual flakes. It is not necessary for each flake to be perfectly aligned with each other, or with the plane of the substrate, but suitable optical effects can be obtained when a sufficient portion of the flakes are suitably aligned.

Unfortunately, some operations do not lend themselves to planar alignment of pigment flakes and others actually contribute to the degradation of alignment of flakes that are applied in a generally planar fashion. Therefore, it is desirable to produce objects incorporating pigment flakes with improved planar alignment of the flakes.

SUMMARY OF THE INVENTION

The present invention provides enhanced visual appearance of objects using flake pigments. In one embodiment, magnetic pigment flakes are applied to a surface of a substrate. A magnetic field is then applied to more closely align at least a portion of the magnetic pigment flakes to a plane of the surface of the substrate. The visual appearance is enhanced because of the aggregate optical effect of the planarized pigment flakes. In another embodiment of the invention, flakes are applied to a surface and then burnished to planarize the flakes.

In a particular embodiment, an image is printed on a document using a printing technique that aligns flakes to the plane of the substrate during application, but de-planarizes the flakes when completing the printing process. Magnetic color-shifting pigment particles in a fluid carrier to a surface of a substrate, and a magnetic field is applied to more closely align at least a portion of the magnetic color-shifting pigment particles to a plane of the surface of the substrate. Typically, the flakes are fixed after planarization by drying or curing the carrier. Such images can be used for decorative or security purposes, such as an anti-counterfeiting device on a bank note.

DETAILED DESCRIPTION OF THE INVENTION

I. Introduction

The present invention provides enhanced visual effects using magnetic pigment flakes. The magnetic pigment flakes are dispersed in a fluid carrier that allows the magnetic pigment flakes to respond to torque arising from a magnetic field applied across the flake. In another embodiment, flakes are physically flattened by burnishing a printed image while the carrier is sufficiently plastic to allow orientation of the flakes into the plane of the substrate.

I. Exemplary Printing Applications

Figure 1A:
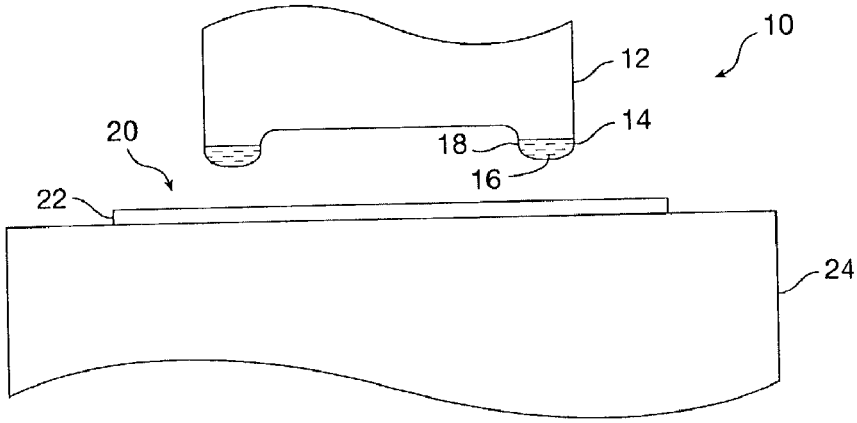
FIGS. 1A-1C are simplified side views of a printing apparatus before, during, and after printing illustrating de-planarization of pigment flakes.

FIG. 1A is a simplified side view of a printing apparatus 10. A die 12 has an engraved face, and ink 14 has been applied to the face. The ink includes magnetic pigment flakes 16 dispersed in a fluid carrier 18, such as an ink vehicle or a paint vehicle. The carrier could be transparent, such as a clear or tinted vehicle, or semi-transparent, and ink may include other pigment particles.

The pigment flakes are generally small, thin flakes that are flat or reasonably flat. Typical dimensions for a flake might be about twenty microns across and about one micron thick; however, these dimensions are merely exemplary and not limiting. Much larger or much smaller flakes could be used, as could flakes with different aspect ratios. Optically variable pigment ("OVP"™) pigment flakes include an optical interference structure, such as a Fabry-Perot structure, made from thin film layers. The OVP shifts color with viewing angle. Different optical designs can produce various hues and color travel. A thin film layer of magnetic material, such as a layer of nickel or PERMALLOY about 25 to about 250 nm thick can provide a suitable magnetic structure for aligning pigment flakes. Other magnetic materials could be used, and suitable materials might be form permanent magnets or not, but it is generally desirable to avoid permanent magnetization of the flakes prior to application to avoid clumping. Some pigment flakes might be simply made from magnetic material, such as nickel flakes, which could be used for a reflective, non-color-shifting effect.

The magnetic pigment flakes 16 on the face of the die are shown as being reasonably well aligned in a plane corresponding to the surface 20 of the substrate 22, which is supported by a plate or table 24. The substrate could be paper, film, laminate, card stock, fabric, leather, plastic, or metal, for example. For convenience of discussion, a paper substrate will be used as an example. The flakes can be aligned on the face of the die in a variety of fashions. Flakes tend to follow the flow of the carrier so as to present the least fluid resistance. Flakes in a carrier (e.g. ink) can be aligned to a surface by drawing the ink into a thin layer along the surface with a blade or squeegee. The die can then pick up the drawn flakes and print them onto the substrate.

Figure 1B:
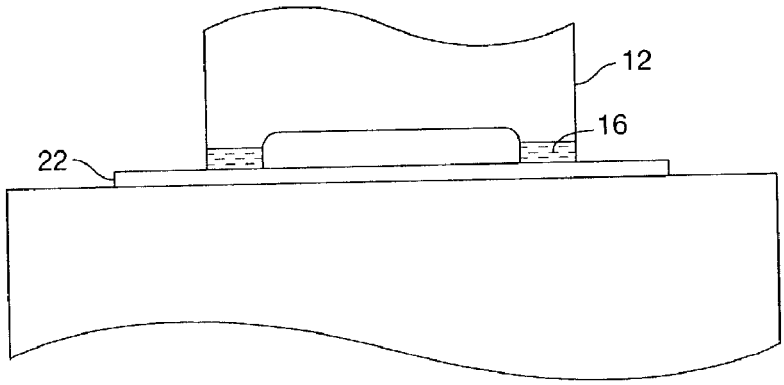
Figure 1C:
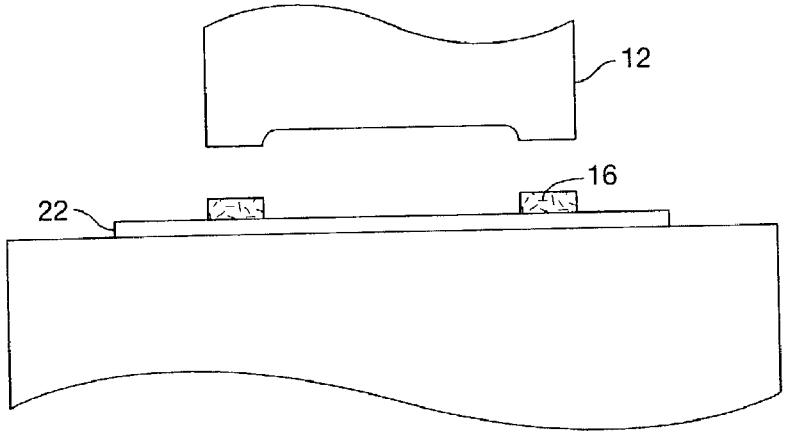

FIG. 1B is a simplified side view of the die 12 contacting the substrate 22 with the magnetic pigment flakes 16 remaining relatively aligned, and FIG. 1C is a simplified side view showing how the magnetic pigment flakes 16 have been pulled out of planar alignment when the die 12 was lifted off the substrate 22. This de-planarization occurs in other printing processes.

Figure 2A:
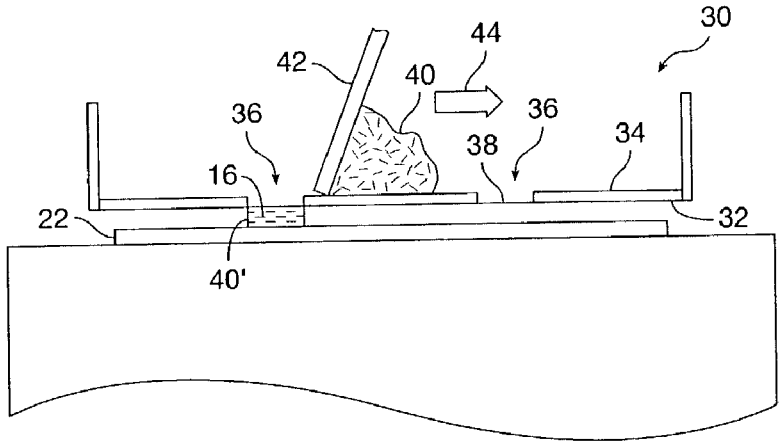
FIGS. 2A-2C are simplified side views of a screen printing apparatus before, during and after printing illustrating de-planarization of pigment flakes.

FIG. 2A is a simplified side view of a screen printing apparatus 30 such as a silkscreen apparatus. Such techniques use a patterned screen 32. The pattern can be defined a number of ways, one of which is using a photo-sensitive emulsion 34 that is developed to open windows 36 in the patterned screen. The actual "silk" screen 38 is very thin and fine, and allows the ink or paint to pass through.

Ink 40 is drawn across the screen with a blade or squeegee 42 in the direction shown by the arrow 44. Drawing the ink across the screen with the squeegee tends to align the pigment flakes 16 in the printed ink 40' in the plane of the substrate 22 because flakes tend to align along the direction of fluid flow and the act of drawing the squeegee across the screen and substrate tends to align the flakes as shown.

Figure 2B:
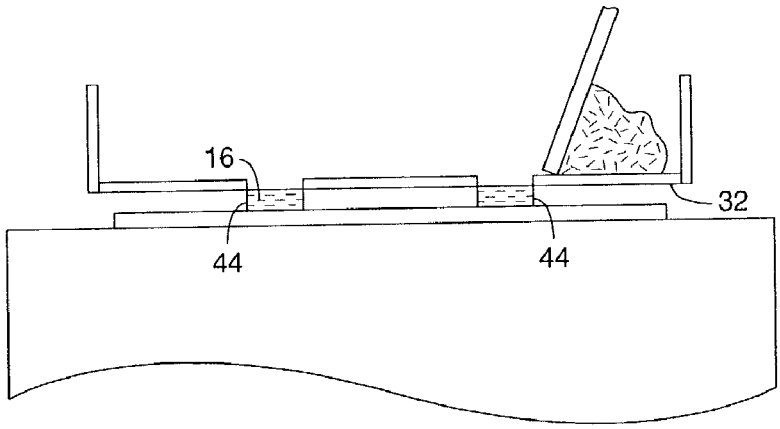
Figure 2C:
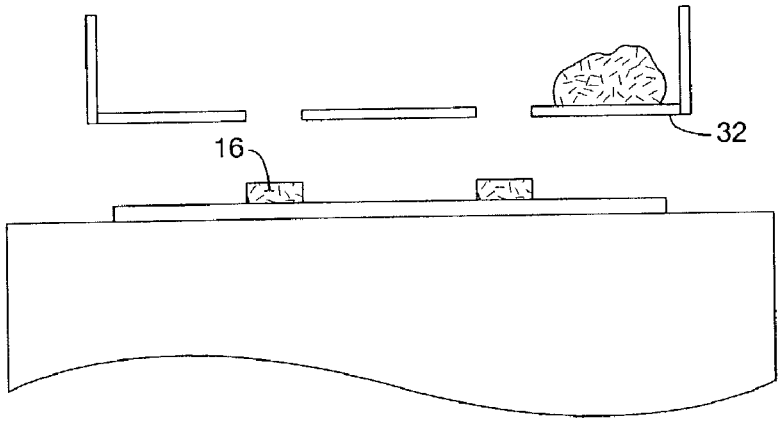

FIG. 2B is a simplified side view showing the alignment of the pigment flakes 16 in the printed portions 44 while the patterned screen 32 is still in contact. FIG. 2C illustrates how the pigment flakes 16 are de-planarized when the patterned screen 32 is lifted from the substrate 22.

The de-planarization that occurs degrades the optical effect(s) that might otherwise be obtained if the flakes retained their as-applied planarization. Other processes might not produce initially planarized flakes, such as spray or jet processes, and even if as-applied planarization is maintained, improvements in the visual quality of the printed image might be obtained with further planarization of the flakes. Thus, it is desirable to be able to planarize pigment flakes after application to a substrate.

II. Magnetic Planarization of Pigment Flakes

Figure 3A:
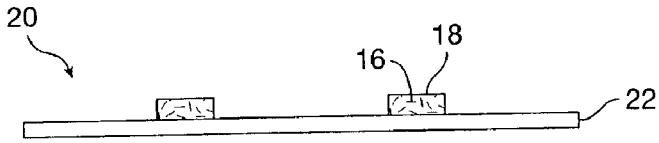
FIG. 3A is a simplified side view of a print with de-planarized magnetic pigment flakes.

FIG. 3A is a simplified side view of a substrate 22 with non-planarized magnetic pigment flakes 16 in a fluid carrier 18 on the surface 20 (i.e. the plane) of the substrate 22. The non-planarized magnetic pigment flakes may be applied using a technique that does not sufficiently planarize the flakes, or that de-planarizes the flakes to some extent, including current techniques that produce an aggregate visual effect of the flakes as-applied. It is understood that some of the pigment flakes might lie in the plane of the substrate, but that many do not and that generally an enhanced visual effect might be obtained by aligning more flakes to the plane of the substrate ("planarization").

Figure 3B:
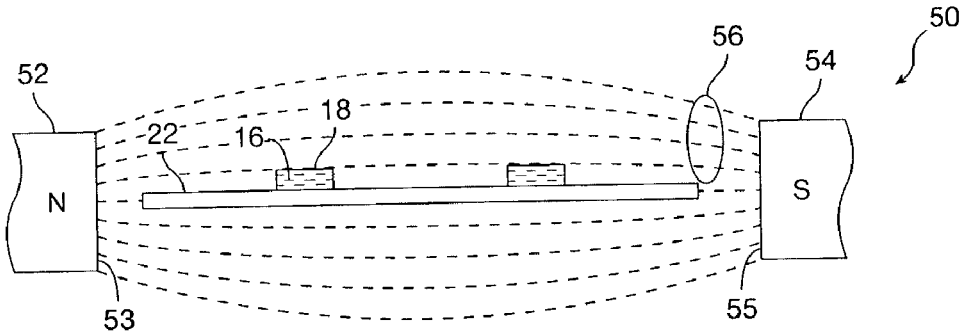
FIG. 3B is a simplified side view of magnetically planarized pigment flakes according to an embodiment of the present invention.

FIG. 3B is a simplified side view of an apparatus 50 for planarizing magnetic pigment flakes 16 according to an embodiment of the present invention. Magnets 52, 54 are configured to create magnetic field lines, represented by the dashed lines 56, essentially in the plane of the substrate 22. The magnetic pigment flakes, which are dispersed in the fluid carrier 18, tend to align themselves along the magnetic field lines so that the major surfaces of the flakes are more parallel to the surface of the substrate, and hence to each other. The magnets are arranged with the north pole 53 of one magnet facing the south pole 55 of another, although different magnet configurations are possible. After aligning the flakes, the carrier is fixed, typically by drying, setting, or curing.

In some print operations, the substrate moves past the magnets at speeds in the range of about 2 meters/second, and the carrier rapidly dries after the ink is applied to the substrate. The planarization of the flakes occurs in only a few milliseconds. Permanent magnets commonly known as "supermagnets", such as Nd—Fe—B magnets, can produce sufficiently high fields to planarize magnetic pigment flakes in a high-speed printing operation. Electro-magnets may be used in some embodiments, but tend to be bulkier than permanent magnets of comparable strength and the coils, which require electric current, generate heat. Such permanent supermagnets are capable of producing magnetic field strengths of up to 70,000 Amps/meter, although other processes may operate with different magnetic field strengths. Factors such as the time available for planarization, viscosity of the carrier, size of the flake, and magnetic characteristics of the flake may affect the desired alignment of the flakes. Similarly, it is understood that even after magnetic planarization not all flakes are perfectly aligned in the plane of the substrate, and that improvement in the visual characteristics of the image formed with the magnetic pigment flakes is a matter of degree, the suitability of which might depend on the initial state flakes and the desired effect, for example.

Figure 3C:
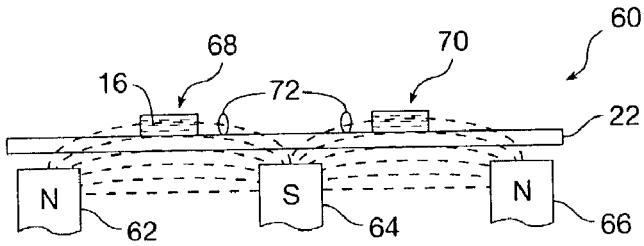
FIG. 3C is a simplified side view of magnetically planarized pigment flakes according to another embodiment of the present invention

FIG. 3C is a simplified side view of an apparatus 60 according to another embodiment of the present invention for planarizing magnetic pigment flakes 16 that have been applied to a substrate 22. Magnets 62, 64, 66 are arranged below the substrate 22 with their respective north and south poles as shown. The magnets are arranged relative to the printed fields 68, 70 so that the magnetic field lines 72 are essentially parallel to the plane of the substrate.

Another embodiment might have closely spaced opposing magnets (north-north or south-south) on opposite sides of the flakes, such as for planarizing flakes during extrusion of a plastic film. In that case, there might not be a separate "substrate". The curing or setting plastic fixes the orientation of the flakes in the film.

The planarization of the flakes enhances the aggregate visual effect of the flakes. In the case of optically variable pigment, brighter, more intense colors are obtained. In a particular example, optically variable pigment was used to make ink that was applied to test cards using a silk-screen technique. One card was allowed to dry as normal, while a magnetic field was applied to a second card before the ink vehicle (carrier) dried to planarize the pigment flakes in the plane of the substrate. The chroma was measured for each sample. The planarization increased the chroma ten percent, which is a very significant increase. Such an increase in chroma over the existing printing technique would be very difficult to achieve by changing the optical design of the pigment flakes, for example, by changing the material of the thin film layers or number of thin film layers. It is believed that it may be possible to improve the chroma of images printed with an Intaglio process using magnetically optically variable pigments up to forty percent. Thus a significant improvement in the visual impression of an image printed with optically variable pigment flakes is obtainable without changing the optical design of the flake. The addition of a magnetic structure in the flake allows the flake to be planarized after application.

Figure 4:
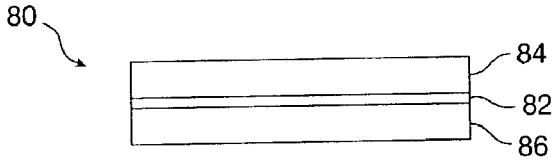
FIG. 4 is a simplified side view of an exemplary pigment flake suitable for use in embodiments of the present invention.

FIG. 4 is a simplified side view of a magnetic pigment flake 80 suitable for use in embodiments of the present invention. A magnetic structure 82 is between optical structures 84, 86. The optical structures could be Fabry-Perot structures having a reflective layer next to the magnetic structure, a spacer layer, and then an absorber layer, as is well-known in the art of optically variable pigments, for example. In some cases, the magnetic layer 82 can serve as the reflector in the Fabry-Perot structures, such as if it is a layer of nickel. Nickel and PERMALLOY layers about 50 nm thick have been found to provide magnetic alignment of color-shifting pigment flakes with Fabry-Perot optical structures where the flakes are about one micron thick and about 20 microns across (average). Other optical structures, such as dielectric thin-film interference stacks, could be used, or the optical structures could be omitted, such as in the case of a metallic magnetic flake, and other layers could be added, such as tinted layers or layers for environmental protection. Although the flake is illustrated as a being symmetrical, this is not required, but is generally desirable to achieve the desired aggregate optical effect.

Figure 5:
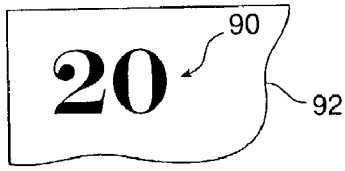
FIG. 5 is a simplified plan view of an exemplary image printed according to an embodiment of the present invention.

FIG. 5 is a simplified plan view of an exemplary image 90 printed according to an embodiment of the present invention on a substrate 92, such as paper. The image could be a security, authentication, or anti-counterfeiting device printed on a bank note, label, or product packaging, for example. Paint or ink containing magnetic pigment flakes is applied to a substrate, and a magnetic field is applied to planarize magnetic pigment flakes.

III. Exemplary Methods

Figure 6A:
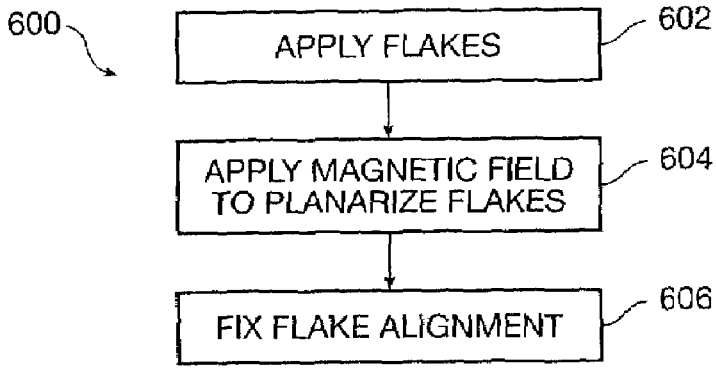
FIG. 6A is a simplified flow chart of a method for flattening magnetic pigment flakes according to an embodiment of the present invention.

FIG. 6A is a simplified flow chart of a method 600 for flattening magnetic pigment flakes according to an embodiment of the present invention. Magnetic pigment flakes in a fluid carrier are applied to a substrate (step 602). A magnetic field is applied to the magnetic pigment flakes to align the flakes in the plane of the substrate (step 604) while the carrier is still fluid. The carrier then typically dries, cures, or sets to fix the alignment of the flakes (step 606). In some embodiments the substrate is static relative to the magnetic field, which in other embodiments the substrate is moving, sometimes at high-speed. The substrate might be a large sheet of paper with several printed images on it, or even a roll of paper.

Figure 6B:
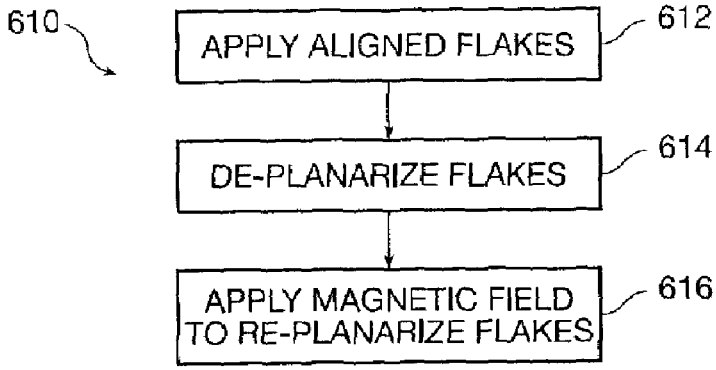
FIG. 6B is a simplified flow chart of a method for re-planarizing magnetic pigment flakes according to an embodiment of the present invention.

FIG. 6B is a simplified flow chart of a method 610 for re-planarizing magnetic pigment flakes according to an embodiment of the present invention. Magnetic pigment flakes in a fluid carrier are partially aligned (step 612) during application, such as during a silk-screen printing operation or some Intaglio printing operations. The flakes are de-planarized (step 614) when the screen or die is lifted from the substrate, for example. A magnetic field is applied to the magnetic pigment flakes to align the flakes in the plane of the substrate (step 616) while the carrier is still fluid.

Figure 6C:
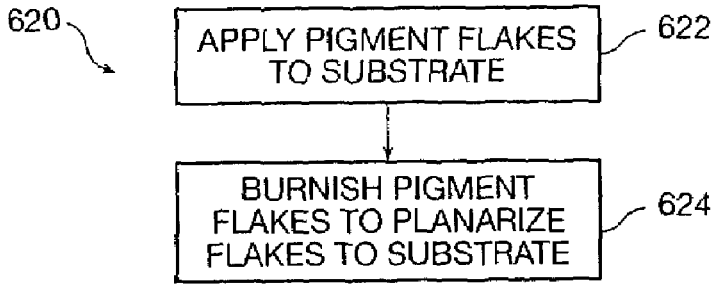
FIG. 6C is a simplified flow chart of a method for flattening magnetic pigment flakes according to another embodiment of the present invention.

FIG. 6C is a simplified flow chart of a method 620 for flattening pigment flakes according to another embodiment of the present invention. Pigment flakes are applied to a substrate (step 622) and then burnished (step 624) to physically press the flakes to align with the plane of the substrate. If the pigment flakes are supplied in a carrier, the carrier is typically plastic enough to allow slight re-alignment of the flakes, which do not have to be magnetic flakes. Burnishing can be accomplished by passing the printed substrate between two rollers that provide sufficient pressure to align the flakes to the plane of the substrate, for example. A static substrate could be burnished simply by rubbing or rolling a smooth object over the printed image, supported by a plate or table, to press the flakes into the plane of the substrate.

While the invention has been described above in reference to particular embodiments and the best mode of practicing the invention, various modifications and substitutions may become apparent to those of skill in the art without departing from the scope and spirit of the invention. Therefore, it is understood that the foregoing descriptions are merely exemplary, and that the invention is set forth in the following claims.

We claim:

1. A method of printing an image on a document, the method comprising steps of:

applying magnetic color-shifting pigment flakes in a fluid carrier to form the image on a surface of a substrate, wherein the step of applying the magnetic color-shifting pigment flakes includes steps of mechanically aligning the magnetic color-shifting pigment flakes to the plane of the surface of the substrate during a first portion of the step of applying, and then de-planarizing at least a portion of the mechanically aligned magnetic color-shifting pigment flakes during a second portion of the step of applying;

applying a substantially parallel magnetic field across the image between separate spaced magnets spanning the image or a portion thereof to more closely align at least a portion of the magnetic color-shifting pigment flakes to the surface of the substrate to enhance an aggregate visual effect of the image; and fixing the alignment of the magnetic color-shifting pigment flakes.

2. The method of claim 1 wherein the document is a bank note.

3. The method of claim 1 wherein the document is a label.

4. The method of claim 1 wherein the step of applying comprises silk-screen printing.

5. The method of claim 1 wherein the step of applying comprises Intaglio printing.

6. The method of claim 1 wherein the step of applying the magnetic field restores chroma of the image.

7. The method of claim 1 wherein the step of applying the magnetic field enhances chroma of the image.

8. A method of printing an image on a document, the method comprising steps of:

applying magnetic reflective pigment flakes in a fluid carrier to form the image on a surface of a substrate, wherein the step of applying the magnetic reflective pigment flakes includes steps of mechanically aligning the magnetic reflective pigment flakes to the plane of the surface of the substrate during a first portion of the step of applying, and then de-planarizing at least a portion of the mechanically aligned magnetic reflective pigment flakes during a second portion of the step of applying;

applying a substantially parallel magnetic field across the image between separate spaced magnets spanning the image or a portion thereof to more closely align at least a portion of the magnetic reflective pigment flakes to the surface of the substrate to enhance an aggregate visual effect of the image; and fixing the alignment of the magnetic reflective pigment flakes.

9. The method of claim 8 further comprising a step, after the step of applying the magnetic reflective flakes, of applying a tinted layer over the magnetic reflective flakes.

10. The method of claim 8 wherein the magnetic reflective flakes are dispersed in a tinted carrier.

11. A method of printing an image on a substrate, the method comprising steps of:

applying a plurality of magnetic pigment flakes to form the image on the substrate wherein a first portion of the plurality of magnetic pigment flakes are aligned essentially parallel to a surface of the substrate, then mechanically de-planarizing a second portion of the first portion of the plurality of magnetic pigment flakes on the surface of the substrate, and then re-planarizing a third portion of the second portion of the plurality of magnetic pigment flakes to lie essentially parallel to the surface of the substrate by applying magnetic field lines between two separate magnets spanning the substrate or a portion thereof essentially in the plane of the surface of the substrate across the image.

* * * * *